United States Patent [19]

Pertramer et al.

[11] Patent Number: 4,462,327

[45] Date of Patent: Jul. 31, 1984

[54] MAST FOOT FOR SAIL BOARDS

[75] Inventors: Siegfried Pertramer, Fürstenfeldbruck; Joachim Adamek, Munich; Ernstfried Prade, Weilheim, all of Fed. Rep. of Germany

[73] Assignee: Mistral Windsurfing AG of Grindelstrasse, Bassersdorf, Switzerland

[21] Appl. No.: 344,951

[22] Filed: Feb. 2, 1982

[30] Foreign Application Priority Data

Feb. 3, 1981 [DE] Fed. Rep. of Germany ..... 3103586
Jan. 15, 1982 [DE] Fed. Rep. of Germany ..... 3201143

[51] Int. Cl.[3] ..... B63B 15/02
[52] U.S. Cl. ..... 114/90; 114/39
[58] Field of Search ..... 114/39, 90, 91, 92, 114/108, 109, 205, 213, 215, 216, 217; 403/220, 221, 349

[56] References Cited

U.S. PATENT DOCUMENTS 2,862,738 12/1958 Bayley ..... 403/349
4,073,254 2/1978 Marker ..... 114/39
4,166,425 9/1979 Kummetz ..... 114/90

FOREIGN PATENT DOCUMENTS 2802656 7/1979 Fed. Rep. of Germany ..... 114/39
2452417 11/1980 France ..... 114/39

*Primary Examiner*—Trygve M. Blix
*Assistant Examiner*—Jesûs D. Sotelo
*Attorney, Agent, or Firm*—Armstrong, Nikaido, Marmelstein & Kubovcik

[57] ABSTRACT

A mast foot for sail boards having a universal joint for connection of the mast through the mast foot, with the sail board hull. The universal joint is joined up by way of a middle pin forming part of a bearing unit, which is designed to be fixedly joined to the hull. The middle pin is furthermore able to be moved, together with the universal joint, in relation to the rest of the bearing unit against the force of a spring in a direction generally normal to the deck of the sail board. The spring may be adjusted with respect to the force produced by it acting against upward motion of the middle pin. The bearing unit can be joined with the sail board hull in a sleeve by way of a turning joint like a bayonet connection.

15 Claims, 8 Drawing Figures

MAST FOOT FOR SAIL BOARDS

BACKGROUND OF THE INVENTION

The present invention is with respect to a mast foot structure for a sail board having a universal joint joining the mast with the sail board, there being an adjustable spring part for stopping injuries, more specially those otherwise caused by limbs of the boardsailor being squeezed between the mast and the top face of the deck.

Such a mast foot design has been put forward in an earlier invention of the applicant, see German Auslegeschrift specification 2,747,057. This known mast foot was designed as a safety connection using adjustable spring parts with the purpose of stopping injury, more specially injuries likely to be caused by the boardsailor's foot being squeezed between the mast and the top face of the deck of the board, the force which had to be overcome before the spring part let go of the mast being adjustable. On release of the spring part, acting as a sort of safety "binding" or connection the complete mast foot with the mast and the rig with it came out of a hole in the surf board hull so that the complete rig had to be joined to the board hull with a special leash. Although the general idea of this safety mast foot certainly gives the desired effect of stopping injury, because, in view of the fact that it may be adjusted by the boardsailor like a ski binding may be adjusted by a skier, it is possible for the danger of injury caused by limbs being squeezed to be completely put to an end, there is the shortcoming however that, more specially if the force to which the spring part is adjusted is low, it may well be that the rig be pulled out of the board hull without this being desired, more specially on pulling the rig out of the water, such as on sailing in choppy water or on surfing in breakers near the beach and in strong winds. Once the rig has been pulled out of the hull, the hull may no longer be maneuvred and there is a chance of the boardsailor falling from the board. This is specially undesired in competitions.

GENERAL OUTLINE OF THE INVENTION

For this reason one purpose of the present invention is that of designing a mast foot of the sort noted which on the one hand is a further development of the general idea of a safety connection or "binding" while on the other hand is based on a design making it unnecessary for the mast foot to be separated from the hull of the sail board.

The key idea of the present invention for effecting this purpose is that of designing the mast foot with a sort of "inner elasticity" so that it no longer has to be separated from the sail board for stopping injury, the mast foot simply giving way adjustably.

For effecting this and further purposes of the present invention, a mast foot of the sort in question is so designed that the universal joint is fixed to a base part of a bearing unit, which is or may be joined fixedly to the hull and the base part may be moved upwards together with the universal joint in relation to the rest of the bearing unit against a spring, whose force may be adjusted, generally in a direction normal to the top face of the deck of the sail board hull.

One useful effect produced by the invention is that for producing the safety function a completely new idea is used, inasfar as the connection between the mast foot and the hull is fixed, or may even be made so that it may never be undone or broken, while nevertheless the boardsailor is safeguarded against injury, because the mast foot springingly gives way in a direction generally normal to the deck of the sail board hull. For this reason, in a way quite different than prior art widely used in mast foot designs, it is possible to have forms of the invention in which, while being quite safe with respect to stopping injury, the mast foot or, as part of the invention, the bearing unit is united with the synthetic resin of a sail board hull or is screwed to the hull. A preferred form of the invention is however one in which the mast foot designed on these lines may, as is normally the case, slipped into the hull of the right form in the hull of the sail board and may be taken therefrom. However this male connection is different inasfar as a part of the invention the mast foot is locked as fixedly as possible in such a hull.

A very light and at the same time simple form of the connection between the lower part of the mast foot and the sail board may be produced if the universal joint is fixed on a middle bolt or pin of the bearing unit, which may be joined to the sail board and the middle pin together with the universal joint may be moved in relation to the rest of the bearing unit against a spring. whose force may be adjusted, generally normally to the top face of the deck of the sail board in an upward direction, the bearing unit being designed to be fixed in a sleeve which is fixed to the board hull by a process of lamination or casting, the bearing unit being fixed in the sleeve by a lock unit, the same being a turning lock with a bayonet connection function.

As part of a preferred working example of the invention the bayonet connection takes the form of an outer lip on the mast foot lower part, seated within the sleeve, with two opposite flats, which are moved past two nosepieces, answering to the flat, on the inner face of the sleeve so that by turning the lower part of the mast foot locking in the sleeve takes place. It will be clear that in the case of this working example it is possible to make do without any moving parts and the weight is very much less than with a locking system as in the first working example of the invention we have noted. This working example as part of the main idea of the invention is only possible because of the inner elasticity, stopping any chance of injury by squeezing of limbs, while nevertheless the mast foot with such elasticity is permanently fixed to the hull.

In the case of a more specially preferred working example of the invention the nosepieces are able to springingly give way, their spring force being adjustable, this working example offering the further safety function stopping injuries inasfar as—even although the mast foot is generally strongly joined to the sleeve—on motion greater than the possible motion of the middle pin or bolt, it is possible for the mast foot to be pulled clear so that even in this case there is no chance of serious injury.

In connection with this form of the invention it is more specially possible for the nosepieces to be formed by the two legs of a generally U-like spring part, such legs partly stretching out over the ring-like lip into the hole within the sleeve, this making for a specially strong design as part of the present invention.

Although it is possible to get adjustment of the locking force produced by the two legs simply by bending the spring part outwards or inwards, it is more specially possible for the U-like spring part to be designed to be moved in two slot-like guides of the sleeve so that the spring force acting on the lower part of the mast foot is fixed by the position of the spring part.

In the case of a more specially preferred working example of the invention there is furthermore a locking unit, able to be undone, marking an end position in addition on the lower part of the mast foot, such locking unit stopping twisting of the lower part of the mast foot in relation to the sleeve.

As part of a useful further development of this form of the invention the locking unit takes the form of a pin, acted on by a downward spring force, on the lower part of the mast, the pin being taken up on a hole in the sleeve when the system is in the locked condition.

Furthermore it is more specially possible to have a handle by which the pin may be lifted for undoing the locking unit.

LIST OF FIGURES AND DETAILED ACCOUNT OF WORKING EXAMPLES OF THE PRESENT INVENTION

Further useful details and developments of the invention will be seen from the account now to be given and will be seen, at least in part, in the dependent claims. The forms of the invention now to be detailed using the figures are by way of example only.

Figure 1:
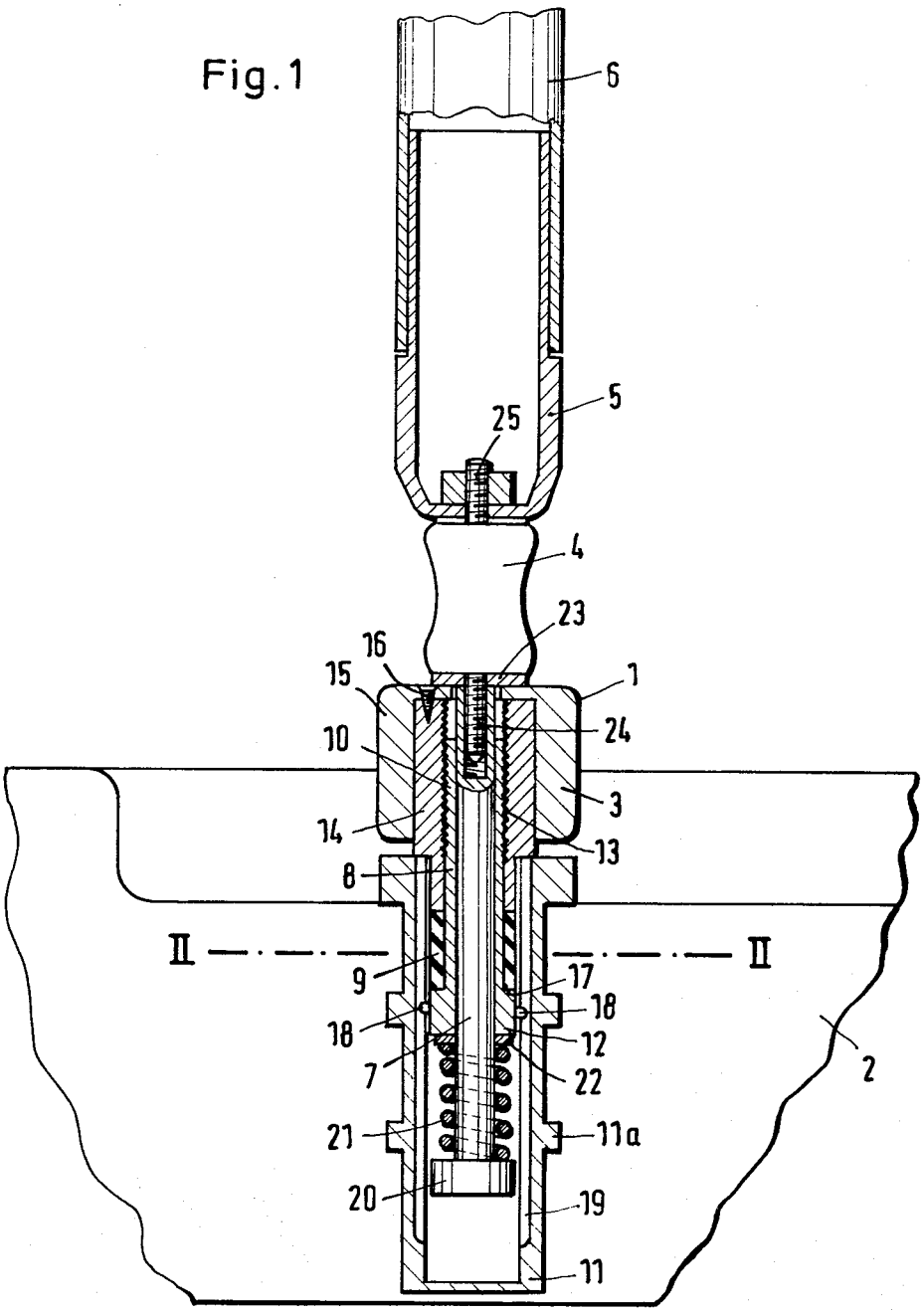
FIG. 1 is a side view and section, which is in part diagrammatic, of one working example of the invention, the mast being seen in its upright position.
Figure 2:
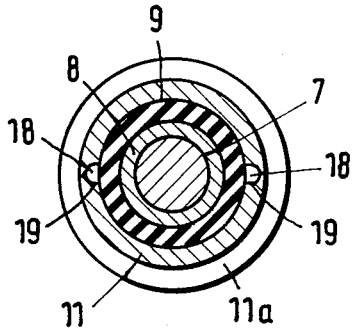
FIG. 2 is a section on the line II—II of FIG. 1.
Figure 3:
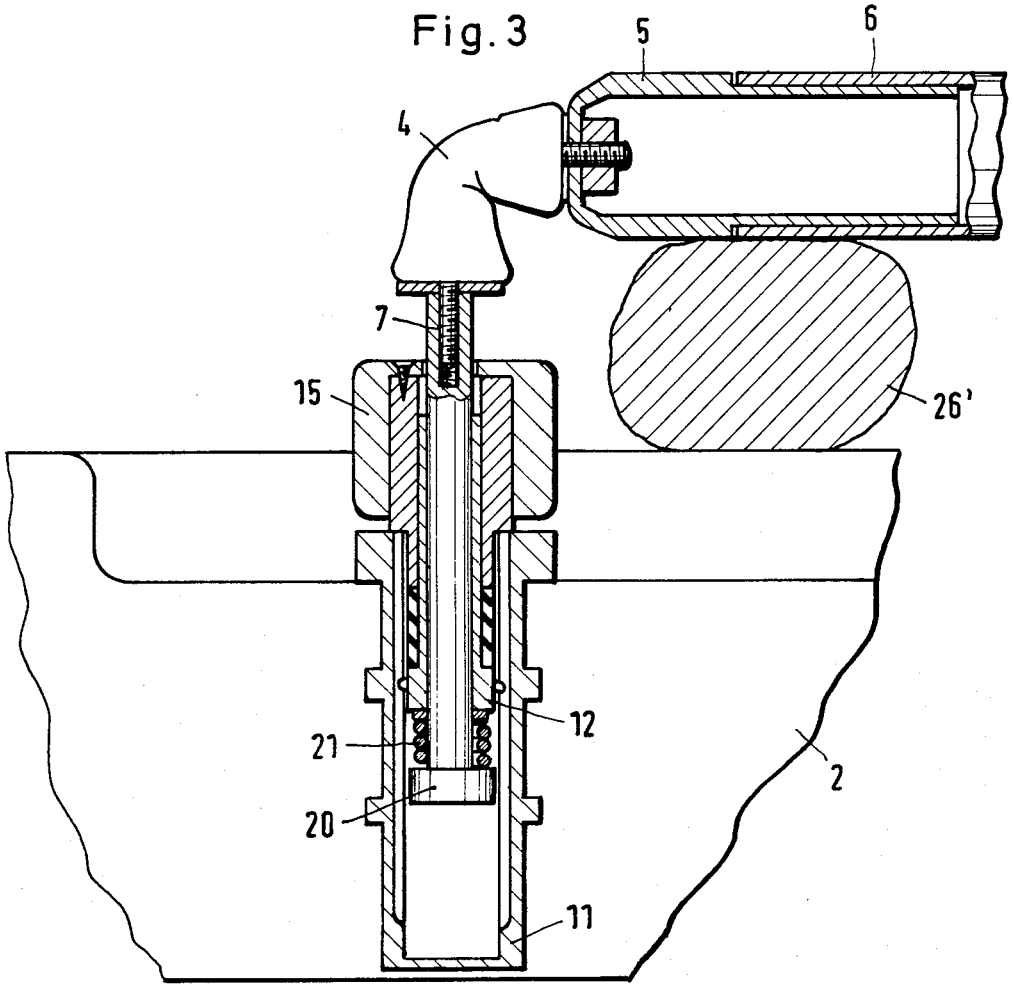
FIG. 3 is a view on the same general lines as FIG. 1 to make clear the function of the mast foot of the present invention.

The mast foot, generally numbered 1 in the working example of the invention to be seen in FIGS. 1 to 3, is joined with the hull 2 of the sail board by way of a male connection which, as will be seen later, may be locked in its done-up condition. The mast foot 1 is made up of a bearing unit or lower part 3 of the mast foot at its lower end, a universal joint 4 in the form of a block of rubber material with plates and bolts 24, 25 vulcanized onto its ends and marketed under the trade name of "Silentblock". Furthermore a tube connection 5 is run into the lower end of mast 6.

The bearing unit 3 has in the present working example, as may best be seen from the section of FIG. 2, generally three concentric parts, that is to say a middle pin or bolt 7, a guide sleeve 8 and a rubber liner 9.

Although the complete bearing unit 3 may be made in one piece with the sail board hull 2, in the present working example a gripping or locking unit 10 is used for locking the bearing unit 3 onto the hull 2. Using gripping unit 10 the mast foot 1 may be locked in a sleeve 11 with locking collars 11*a* which is fixed in the foam material of the sail board hull 2, and for this purpose guide sleeve 8 has at its lower end a wider head part 12 aginst which the rubber liner 9 is rested at 17. Guide sleeve 8 may be moved axially in relation to an adjustment sleeve 14 using a male screw thread 13 running in a female thread sleeve 14. The adjustment sleeve 14 is, for example, joined by screws 16 with a hand knob 15 so that it may be turned by hand, for compressing liner 9 and so jamming guide sleeve 8 in sleeve 11. To make certain that the complete bearing unit 3 is not turned as well in this locking operation, at the wider head part 12 of the guide sleeve 8 there are two opposite nosepieces 18 running in axial grooves 19 of sleeve 11.

It will be seen from the account so far if, after putting the mast foot 1 into the sleeve 11, it is to be locked therein, hand knob 15 is turned so that the guide sleeve 8 is moved upwards in relation to the adjustment sleeve 14 because of the effect of the threaded connection, that is to say thread 13 in the thread of sleeve 14, for which reason the rubber liner is bent outwards and forced strongly against the inner face of sleeve 11. Simply by turning hand knob 15 it is for this reason possible to make a connection, which does not come undone even under the roughest sailing condition, between the mast foot 1 and the hull 2.

As will be seen from FIG. 1, the middle pin 7 has, at its lower end, a radially wider head part 20, a helical spring 21 being placed between the head part 20 and the head part 12 of guide sleeve 8, it being possible to have a washer 22 on the top end of spring 21.

The middle pin 7 is taken up in the guide sleeve 8 with a loose fit so that it may be moved axially against the force of the spring 21 within the guide sleeve upwards and downwards.

At the top end of the middle pin 7 the universal joint 4 is fixed by a screw threaded bolt 24, there being a washer 23 between joint 4 and knob 15. Because in the present working example the universal joint 4 is in the form of a Silentblock having threaded bolts 24 and 25 at its two ends, the tube connection 5, supporting mast 6, is joined up with the universal joint 4 by way of a screw connection as well. Because in the present working example turning the universal joint 4 about the upright axis would take place with the middle pin 7 being turned as well and for this reason might be stopped or braked by the force of the spring 21, it is best for the connection between the universal joint 4 and the tube connection 5 to be such that the connection 5 may be turned freely in relation to the universal joint 4 about the upright axis.

The workings of this working example of the invention for stopping injuries, more specially those otherwise caused by squeezing a limb between the mast 6 and the top face of the deck of hull 2, will best be seen from FIG. 3.

In FIG. 3 part of a limb will be seen marked diagrammatically at 26 in section between the mast 6 and the hull 2 and it will be seen that in this case the middle pin 7, which is guided fully in line by the guide sleeve 8, is pulled upwards against the force of spring 21 so that it is not possible for limb 26' to be heavily squeezed and injured. When the mast 6 is righted again, middle pin 7 is pulled back downwards by spring 21 so that the universal joint 4 automatically goes back into a position resting on the top end of bearing unit 3 when sailing.

The force necessary for producing axial upward motion of the middle pin 7 for stopping any chance of injury may be fixed by using springs 21 in line with the special taste and desire of the boardsailor, or another adjustable connection on the same lines as that between the adjustment sleeve 14 and the guide sleeve 8 may be present for stepless adjustment of the force of spring 21.

In the working example of FIGS. 4 to 8 like part numbers have been used for like parts.

The mast foot generally numbered 1 of the present invention is joined in the case of the present working example with the hull 2 of the sail board by a male connection which, as will be made clear in more detail later, may be locked in position. The mast foot 1 is made up of a bearing unit 3 at the lower end, it forming the lower part of the mast foot, a universal joint 4 in the form of a Silentblock and a tube connection 5, placed over the universal joint 4 and having a male part let into the lower end of the mast 6. The mast 6 is kept in position on tube connection 5 by way of the sail (not shown) the sail having for this purpose a luff downhaul, threaded through a thimble in the sail, to give a downward pulling effect.

The bearing unit 3 forming the lower part of the mast foot is in the present working example (see FIGS. 4 and 6), made up of a sleeve 26 with a guide pin 7 therein.

The locking unit 10 is, as will be made clear later in the present account, designed as a turning connection, that is to say a bayonet connection, in this working example of the invention, the locking unit 10 locking the bearing unit 3 to the hull 2 after putting the mast foot 1 in sleeve 11 fixed in the foam core of the hull 2.

Figure 5:
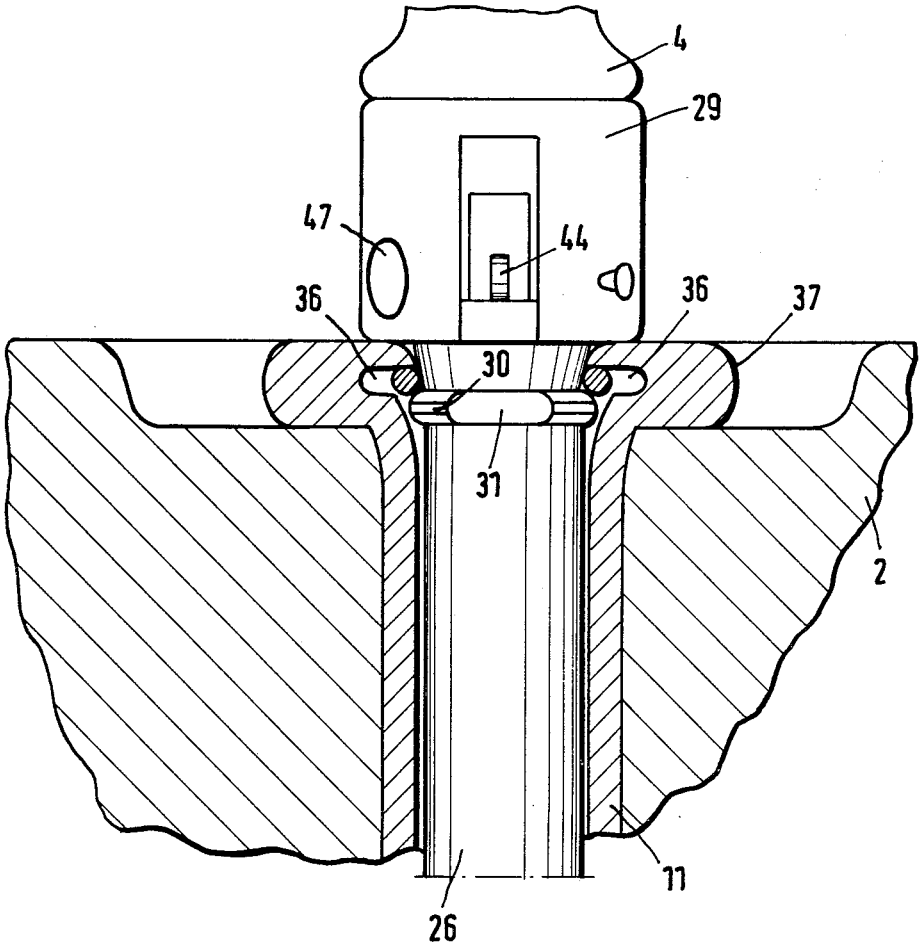
FIG. 5 is a side view, partly cut away of the locking system of the invention to be seen in FIG. 4.
Figure 6:
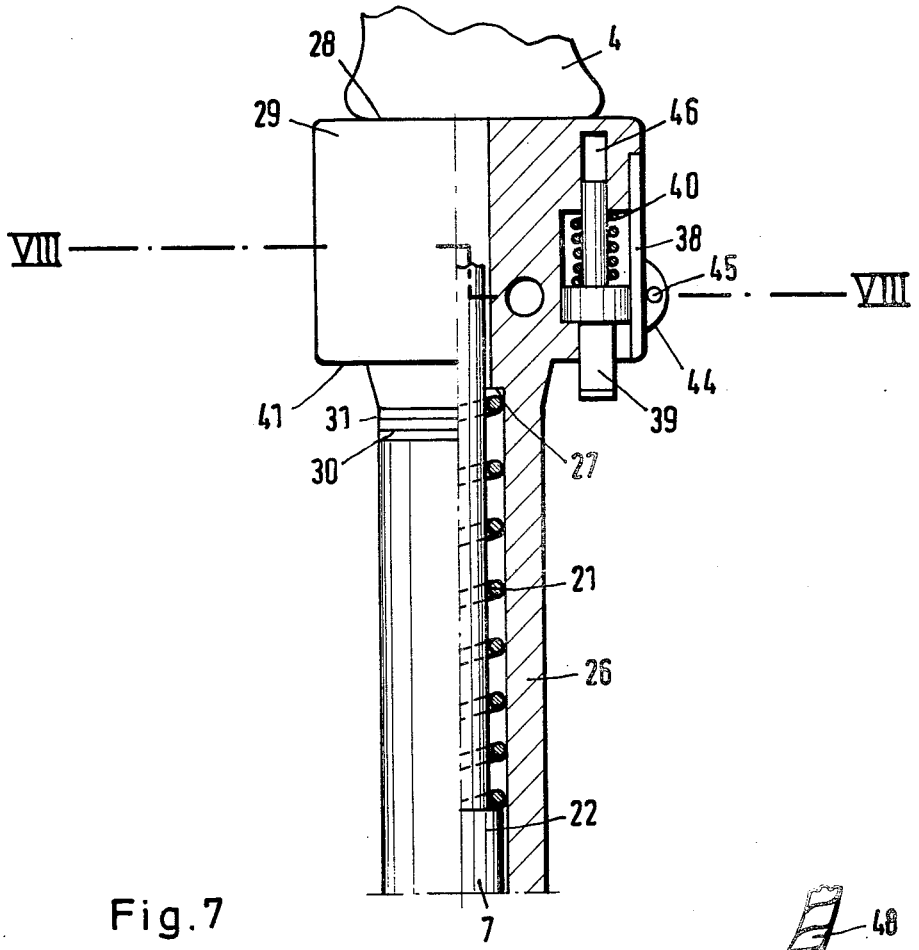
FIG. 6 is a view on the same lines as FIG. 6, but in a different section plane to make clear details of the locking unit.
Figure 7:
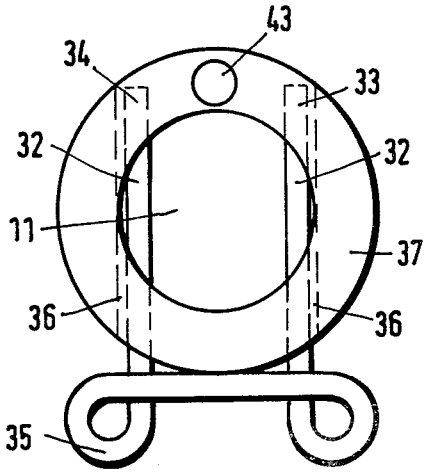
FIG. 7 is a plan view of the sleeve used in the locking system as part of a preferred working example of the invention with one spring part, as used in the working example of FIGS. 4 to 7.
Figure 8:
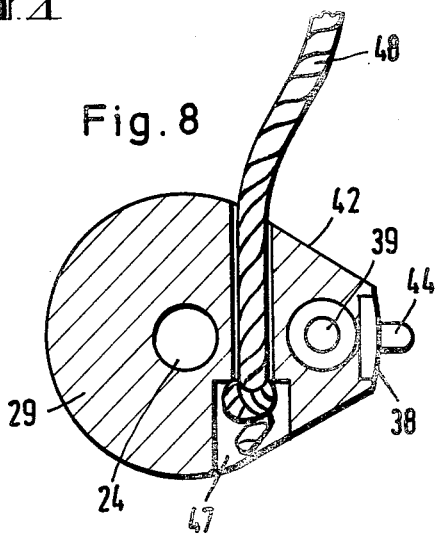
FIG. 8 is a section on the line VIII—VIII of FIG. 6.

A more detailed account will be given later of the bayonet-like locking system, see the more detailed view of FIGS. 5 and 6 in this respect.

Figure 4:
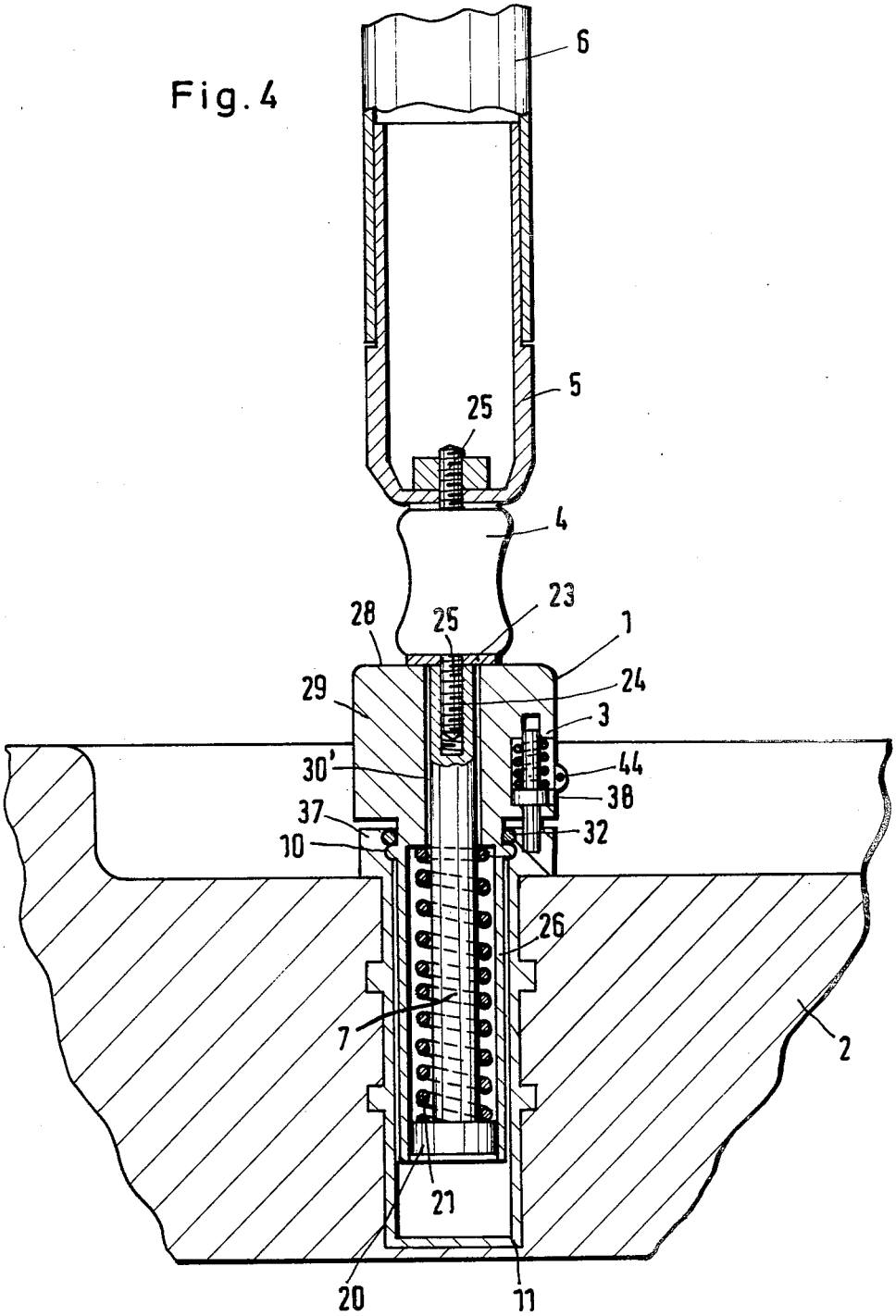
FIG. 4 is a side view and section, in part diagrammatic, of a second working example of the invention with the mast in its upright position.

Turning now to FIG. 4 it will furthermore be seen that the middle pin 7 has a radially wider head part 20 at its lower end, a helical spring 21 being placed between said head part 20 and a shoulder 27 (FIG. 6) at the inner top end of the guide sleeve 26, with a washer 22 therebetween if desired.

The middle pin 7, stretching as far as the top face 28 of the head 29 of the lower part 3 of the mast foot, is taken up with play in a hole 30' in head 29 so that it may be moved axially upwards against the force of spring 21 within guide sleeve 26, and in a downward direction.

The universal joint 4 is fixed at the top end of the middle pin 7, with a washer 23 therebetween, using a screw threaded bolt 24 of the joint 4. Because the universal joint 4 is in the form of a Silentblock in the working example in question which at its two ends has screw threaded stems or bolts 24, 25, tube connection 5 supporting the mast 6 is joined by threaded stem 25 with the universal joint 4 as well. If the universal joint 4 is turned about the upright axis in this working example of the invention the middle pin 7 will be turned as well, the pin however being braked because of the force of the spring 21 acting on it. For this reason it is best for the connection between the universal joint 4 and the tube connection 5 to be so designed that the one part may be freely turned in relation to the other.

The function of the mast foot system with respect to putting an end to any injury, more specially by squeezing of limbs, between mast 6 and the top face of the sail board hull 2 is the same as was the case with the first working example of the invention.

An account will now be given, using FIGS. 5 to 8, of the locking unit 10 of the present invention.

As will be seen the sleeve 26 has a ring-like lip 30 or collar at some distance under head 29 of the lower part 3 of the mast foot, lip 30 having two opposite flats 31, the distance therebetween being the same as the diameter of the guide sleeve 26. Within the top end of sleeve 11 there are two nosepieces (see furthermore FIG. 7) or fingers generally numbered 32, such nosepieces detenting positions right over ring lip 30 when the mast foot 1 has been slipped into its sleeve 11.

In a preferred working example of the invention nosepieces 32 take the form of the two legs 33, 34 of an U-like spring part 35 (FIG. 7), such legs being able to be moved in a radial plane in guide holes 36 or slots in the ear 37 at the top end of sleeve 8.

The radial force acting on the guide sleeve, when slipped in position, over ring lip 30 may be adjusted in this working example of the invention by moving spring part 35 radially in guide holds 36 because the levering distance through which the legs 33 and 34 are then moved when the ring lip 30 is pushed downwards past them will be changed.

The two legs 33 and 34 and the ring lip 30 with its flats 31 together make up a locking system which may be done up and undone by turning, like a bayonet connection, for locking the mast foot in sleeve 11 and to this end the mast foot has to be slipped into sleeve 11 with the flats lined up with legs 33 and 34. When it has been pushed fully home, that is to say so that head 29 of the lower part 3 of the mast foot is seated on ear 37, the lower part 3 of the mast foot is turned through 90° so that the parts will be in the position as seen in FIG. 5.

To make certain that there is no chance of this position of the parts in relation to each other being changed on using the sail board without such change being desired, something which would have the effect of unlocking the system, there is a further locking unit 38 on the head 29 of the lower part 3 of the mast foot. This locking unit, which may be undone by hand, is used for keeping the parts in their locked end position by stopping any turning of the lower part 3 of the mast foot in relation to sleeve 11.

In the present working example head 29 is made broader on one side (see FIG. 8) and the locking unit has a pin 39 pushed downwards by a spring 40 past the lower end face 41 of the onesided, broader part 42 of head part 29. Pin 39 is placed opposite one of flats 31 and, when the mast foot 1 has been put in place, is taken up in a hole 43 (FIG. 7) in ear 37 of sleeve 11 between legs 33 and 34 of spring part 35 in the locked, end position.

The locking unit 38 may, in the present working example in question, be undone and pulled clear of sleeve 11 by lifting it by hand (using an eye 45 in a handle 44) so that the mast foot 1 may be taken out of sleeve 11. If desired a short piece of line may be knotted to eye 45. On unlocking locking unit 38 the pin 39 is simply moved upwards in hole 46 against the force of the spring 40.

Because in this working example of the invention the mast foot 1 may, if overloaded, be completely pulled out of the sail board hull, head part 29 furthermore has a cross-hole 47 for connection with a leash 48 (see FIG. 8) its other end is joined to hull 2, this not being shown.

It will be clear from the account given so far that the mast foot design of this form of the invention is such that the mast foot is joined with the sail board hull by a simple, light-weight and low-price locking system able to be put to rough use without damage. The second example noted gives the further useful effect that even though the mast foot 1 is generally strongly joined with the sail board hull 2 there is nevertheless a further safety factor inasmuch as the mast foot may be completely separated from the sail board hull when it is pulled upwards to such a degree that the guide pin 7 is pulled as far as it will go, compressing spring 21, so that the force of spring part 35 (adjusted as needed) is overcome and spring part 35 unlocked, the rig then only being joined to the hull by leash 48. As noted the guide pin 7 and the spring 21 give the mast foot 1 a system with inner elasticity. Because of this design injury by squeezing of limbs between the mast and the deck will be stopped while nevertheless the design gives a strong connection which may more specially be used for jumping sail boards and is stronger than prior art mast foots.

The force needed for pulling the mast foot completely clear of the hull may be adjusted by changing the position of spring part 35.

Those in the art will be conscious of many further possible designs for putting into effect the main teaching of the present invention, that is to say designing a mast foot with an inner elasticity for stopping injury by squeezing limbs between the mast and the deck while at the same time giving a strong connection or "binding" between the mast foot and the sail board hull, the connection nevertheless making it possible for the mast to be separated from the hull.

All details of the invention given in the specification, the claims and the drawings, together with design details and configurations may be taken to be part of the invention separately or when used together in any possible combination whatsoever.

We claim:

1. A mast foot for sail boards having a universal joining the mast with the hull of the sail board comprising a bearing unit, a middle pin forming part thereof and having said universal joint fixed thereto, said bearing unit being designed to be fixed to said sail board hull, said middle pin being moveable with said universal joint in relation to the rest of the bearing unit upwards generally normal to the hull of said sail board for preventing injury to a user of the board, and an adjustable spring offering resistance to such motion of said middle pin.

2. A mast foot as claimed in claim 1 wherein said bearing unit has a tube-like body with said middle pin placed therein, the spring being placed between a lower end of the tube-like body and a wider head of the middle pin, said middle pin being joined with the universal joint directly.

3. A mast foot as claimed in claim 1 or claim 2 wherein the bearing unit is fixed in said hull by a process selected from the group: casting in said hull; lamination in said hull.

4. A mast foot as claimed in claim 1 or claim 2 having a sleeve fixed in said hull by a process selected from the group: lamination in hull, casting in said hull, said sleeve being designed for taking up said bearing unit, said mast foot furthermore having a locking unit for fixing said bearing unit in said sleeve.

5. A mast foot as claimed in claim 1 having an adjustment driving system for changing the force of said spring.

6. A mast foot as claimed in claim 1 having a base part taking the form of a guide sleeve, said middle pin being guided in said guide sleeve parallel to itself.

7. A mast foot as claimed in claim 1 having a tube connection for supporting a mast for the sail board, the turning motion of the universal joint in relation to other parts of the mast foot being above the joint at the tube connection.

8. A mast foot for sail boards having a universal joint for joining the mast of the hull of the sail board comprising a bearing unit, a middle pin forming part thereof and having said universal joint fixed thereto said middle pin being able to be moved with said universal joint in relation to the rest of the bearing unit upwards generally normal to the hull of the board for preventing injury to a user of the board, and an adjustable spring offering resistance to such motion of such middle pin, said bearing unit being designed for being taken up in a sleeve able to be fixed in the windsurfer hull by a process selected from the group: lamination, casting in place, said mast foot furthermore having a locking unit for fixing the bearing unit in said sleeve, said locking unit being able to be unlocked by turning like a bayonet connection.

9. The mast foot as claimed in claim 8 wherein the locking unit with a bayonet connection function takes the form of an outer ring-lip on the lower part of the mast foot, the ring-lip having two flats and being designed to be locked in place in the sleeve, said mast foot furthermore having two nosepieces, past which said flats may be moved, whereby said mast foot lower part may be locked in said sleeve by turning it.

10. A mast foot as claimed in claim 9 wherein said nosepieces have a spring function, the spring force thereof being adjustable.

11. A mast foot as claimed in claim 10 having an U-like spring part with two legs forming the two nosepieces, said legs being placed at least in part over said ring lip in a hole inside said sleeve.

12. A mast foot as claimed in claim 11 wherein said spring part is able to be moved in two slot-like guide holes in said sleeve.

13. A mast foot as claimed in any one of claims 8, 9, 10, 11 or 12 having a second locking unit marking the locked, end position and able to be undone, such second locking unit stopping turning of the lower part of the mast foot in and in relation to said sleeve.

14. A mast foot as claimed in claim 13 wherein said locking unit comprises a pin, a spring pushing said pin downwards and a hole in said sleeve taking up said pin when pushed into its end position for locking.

15. A mast foot as claimed in claim 14 wherein said second locking unit has a handle for unlocking it by hand.

* * * * *